US005488748A

United States Patent [19]

Koch

[11] Patent Number: 5,488,748

[45] Date of Patent: Feb. 6, 1996

[54] TOILET BOWL CLEANING IMPLEMENT

[76] Inventor: Sharolyn R. Koch, 902 Tanbark St. Southeast, Olympia, Wash. 98513

[21] Appl. No.: 325,866

[22] Filed: Oct. 19, 1994

[51] Int. Cl.[6] ..... A47L 25/00

[52] U.S. Cl. ..... 15/104.94; 15/210.1; 15/244.1; 15/257.01; 206/349; 206/369; 312/42; 312/207

[58] Field of Search ..... 15/104.93, 104.94, 15/209.1, 210.1, 244.1, 257.01; 206/349, 362; 312/42, 206, 207

[56] References Cited

U.S. PATENT DOCUMENTS

| | | | |
|---|---|---|---|
| 4,031,673 | 6/1977 | Hagelberg | 15/210.1 |
| 4,118,824 | 10/1978 | Clement, Jr. | 15/244.1 |
| 4,493,124 | 1/1985 | Agapiou | 15/210.1 |
| 4,987,634 | 1/1991 | Weihrauch | 15/209.1 |

FOREIGN PATENT DOCUMENTS

| | | | |
|---|---|---|---|
| 2826890 | 1/1980 | Germany | 15/244.1 |
| 1181230 | 2/1970 | United Kingdom | 15/244.1 |

*Primary Examiner*—Mark Spisich

[57] ABSTRACT

An implement for cleaning a toilet bowl and surrounding bathroom surfaces. The inventive device includes a handle having a mounting base at a lower distal end thereof. A cleaning pad is removably coupled to the mounting base and can be utilized to scrub a toilet or like structure. A dispenser is provided for supplying new cleaning pads and receiving used cleaning pads for disposal thereof.

9 Claims, 5 Drawing Sheets

TOILET BOWL CLEANING IMPLEMENT

BACKGROUND OF THE INVENTION

1. Field of the Invention

The present invention relates to cleaning structures and more particularly pertains to cleaning structures and more particularly pertains to a toilet bowl cleaning implement for cleaning a toilet bowl and surrounding bathroom surfaces.

2. Description of the Prior Art

The use of cleaning structures is known in the prior art. More specifically, cleaning structures heretofore devised and utilized are known to consist basically of familiar, expected and obvious structural configurations, notwithstanding the myriad of designs encompassed by the crowded prior art which have been developed for the fulfillment of countless objectives and requirements.

Known prior art cleaning structures include U.S. Pat. Nos. 5,110,868; 4,709,425; 4,491,988; 4,216,027; and U.S. Pat. No. D284,693.

While these devices fulfill their respective, particular objectives and requirements, the aforementioned patents do not disclose a toilet bowl cleaning implement for cleaning a toilet bowl and surrounding bathroom surfaces which includes a handle having a mounting base at a lower distal end thereof, and a cleaning pad removably coupled to the mounting base which may be utilized for scrubbing the toilet and surrounding surfaces. Furthermore, none of the known prior art cleaning structures teach or suggest a toilet bowl cleaning implement of the aforementioned structure which further includes a dispenser for supplying new cleaning pads and for receiving used cleaning pads for disposal thereof.

In these respects, the toilet bowl cleaning implement according to the present invention substantially departs from the conventional concepts and designs of the prior art, and in so doing provides an apparatus primarily developed for the purpose of cleaning a toilet bowl and surrounding bathroom surfaces.

SUMMARY OF THE INVENTION

In view of the foregoing disadvantages inherent in the known types of cleaning structures now present in the prior art, the present invention provides a new toilet bowl cleaning implement construction wherein the same can be utilized for cleaning a toilet bowl. As such, the general purpose of the present invention, which will be described subsequently in greater detail, is to provide a new toilet bowl cleaning implement apparatus and method which has many of the advantages of the cleaning structures mentioned heretofore and many novel features that result in a toilet bowl cleaning implement which is not anticipated, rendered obvious, suggested, or even implied by any of the prior art cleaning structures, either alone or in any combination thereof.

To attain this, the present invention generally comprises an implement for cleaning a toilet bowl and surrounding bathroom surfaces. The inventive device includes a handle having a mounting base at a lower distal end thereof. A cleaning pad is removably coupled to the mounting base and can be utilized to scrub the toilet. A dispenser is provided for supplying new cleaning pads and receiving used cleaning pads for disposal thereof.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new toilet bowl cleaning implement apparatus and method which has many of the advantages of the cleaning structures mentioned heretofore and many novel features that result in a toilet bowl cleaning implement which is not anticipated, rendered obvious, suggested, or even implied by any of the prior art cleaning structures, either alone or in any combination thereof.

It is another object of the present invention to provide a new toilet bowl cleaning implement which may be easily and efficiently manufactured and marketed.

It is a further object of the present invention to provide a new toilet bowl cleaning implement which is of a durable and reliable construction.

An even further object of the present invention is to provide a new toilet bowl cleaning implement which is susceptible of a low cost of manufacture with regard to both materials and labor, and which accordingly is then susceptible of low prices of sale to the consuming public, thereby making such toilet bowl cleaning implements economically available to the buying public.

Still yet another object of the present invention is to provide a new toilet bowl cleaning implement which provides in the apparatuses and methods of the prior art some of the advantages thereof, while simultaneously overcoming some of the disadvantages normally associated therewith.

Still another object of the present invention is to provide a new toilet bowl cleaning implement for cleaning a toilet bowl and surrounding bathroom surfaces.

Yet another object of the present invention is to provide a new toilet bowl cleaning implement which includes a handle having a mounting base at a lower distal end thereof, and a cleaning pad removably coupled to the mounting base which may be utilized for scrubbing the toilet and surrounding surfaces.

Even still another object of the present invention is to provide a new toilet bowl cleaning implement of the aforementioned structure which further includes a dispenser for supplying new cleaning pads and receiving used cleaning pads for disposal thereof.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
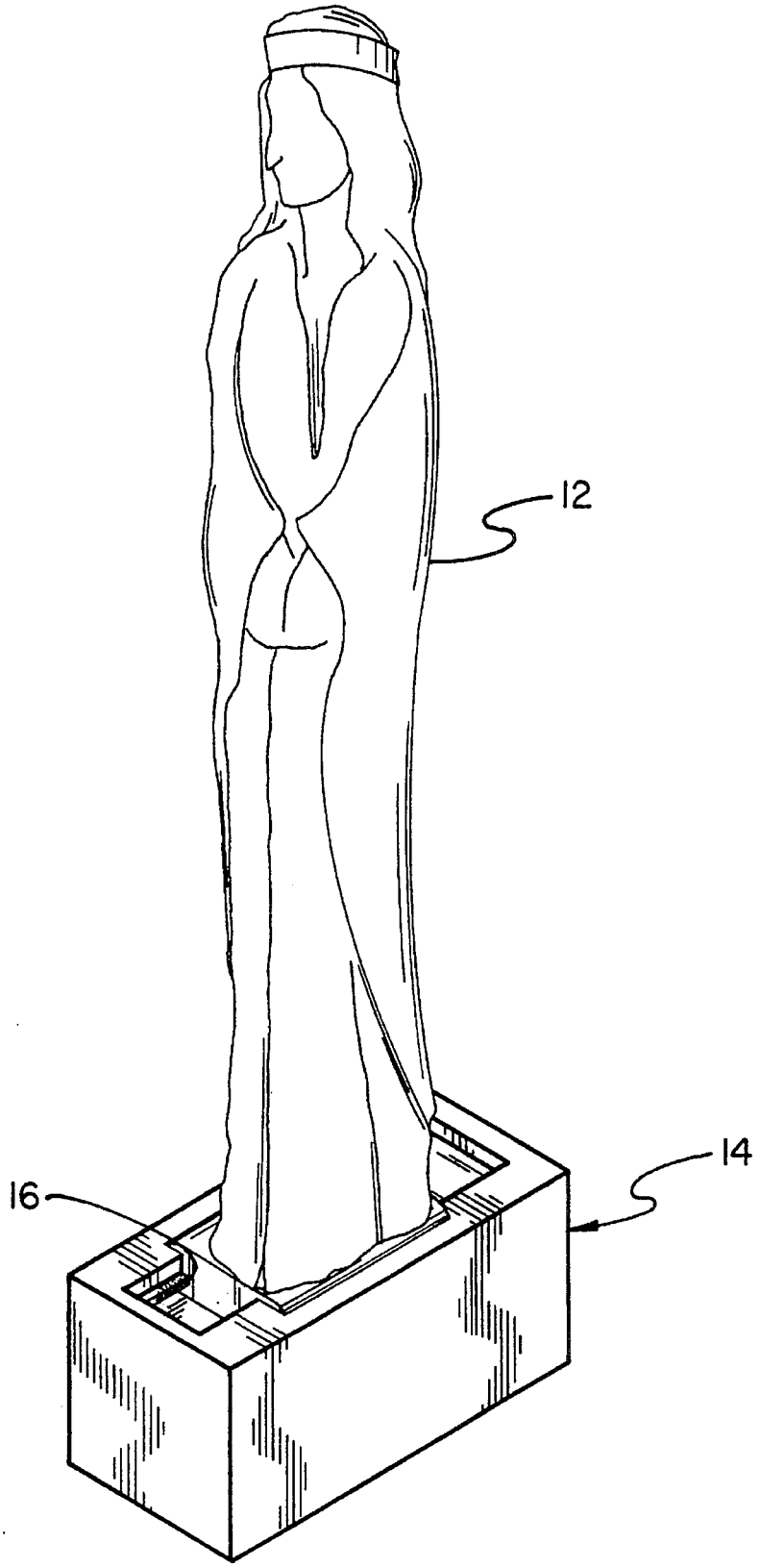
FIG. 1 is an isometric illustration of a toilet bowl cleaning implement according to the present invention.

With reference now to the drawings, and in particular to FIGS. 1–7 thereof, a new toilet bowl cleaning implement embodying the principles and concepts of the present invention and generally designated by the reference numeral 10 will be described.

More specifically, it will be noted that the toilet bowl cleaning implement 10 comprises a handle 12 of substantially elongated configuration and preferably shaped to resemble the form of a goddess, as illustrated in FIG. 1. The handle 12, when the device 10 is not being utilized, can be coupled to a dispensing means 14 for supporting the handle 12 in a substantially vertical orientation and further for supplying a cleaning pad 16 arranged for removable coupling with the lower distal end of the handle 12.

Figure 2:
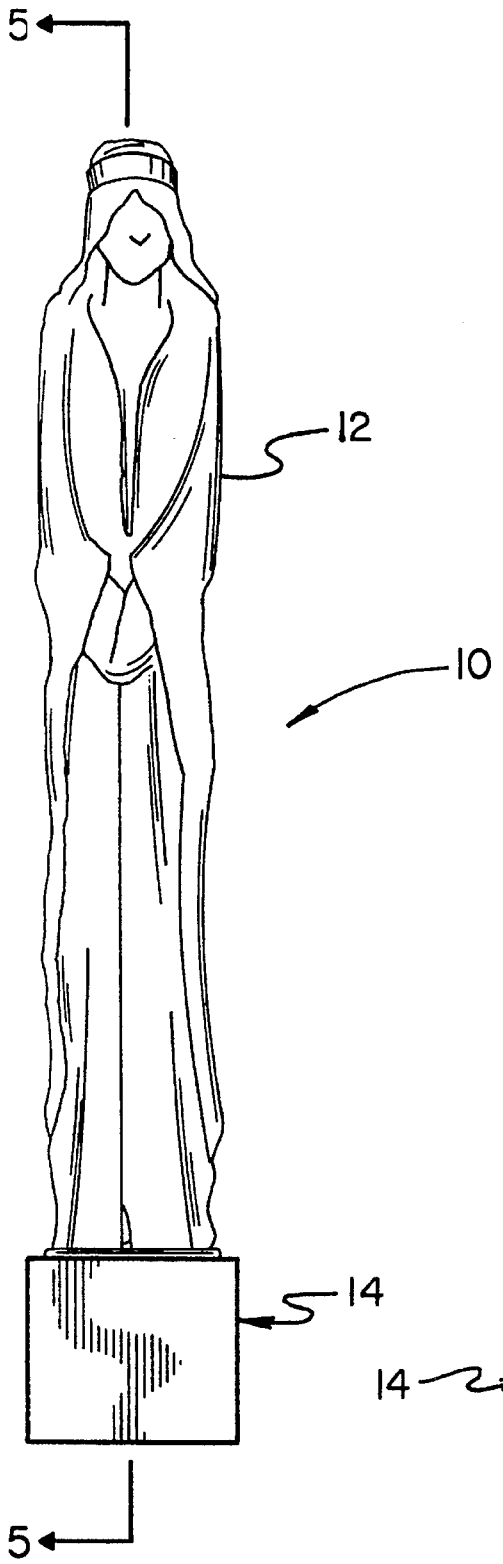
FIG. 2 is a front elevation view thereof.
Figure 3:
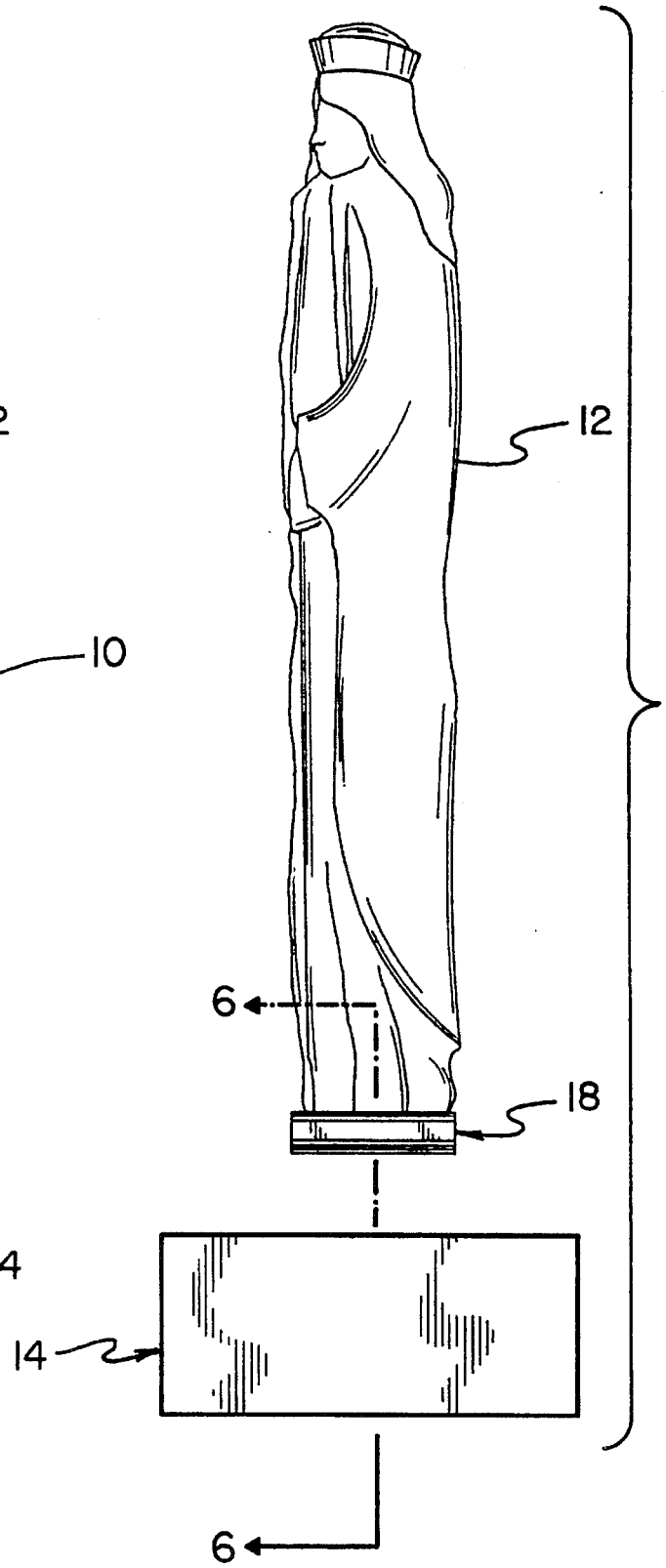
FIG. 3 is a side elevation view of the cleaning implement.
Figure 4:
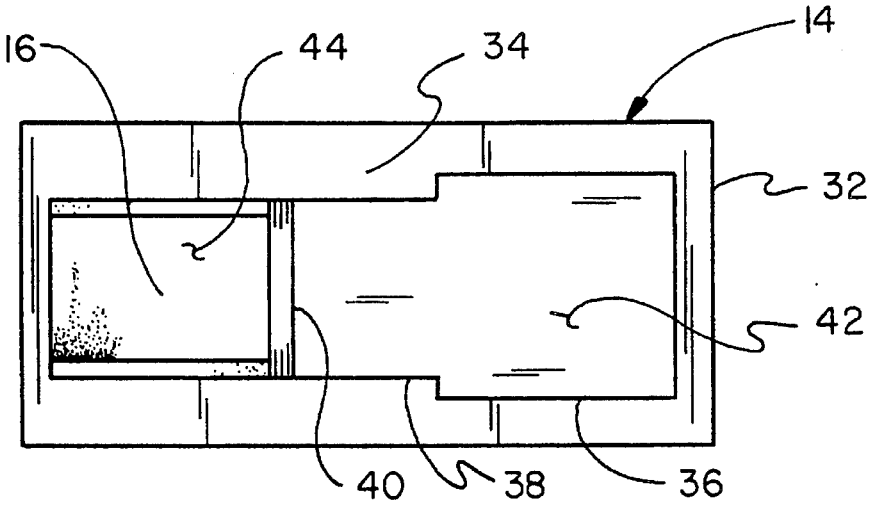
FIG. 4 is a top plan view of a dispensing means comprising a portion of the present invention.
Figure 5:
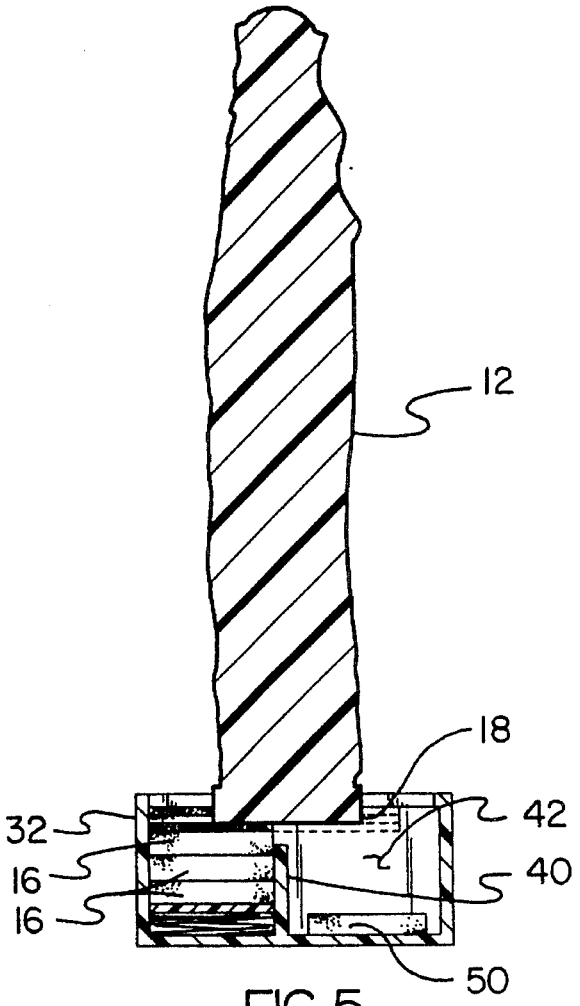
FIG. 5 is a cross-sectional view taken along line 5—5 of FIG. 2.
Figure 6:
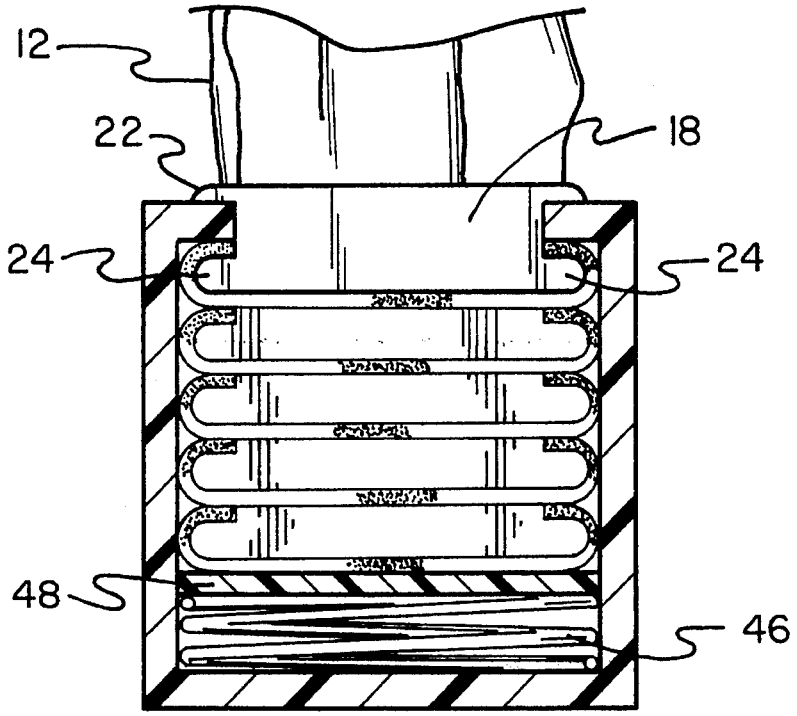
FIG. 6 is a further cross-sectional view taken along line 6—6 of FIG. 3.
Figure 7:
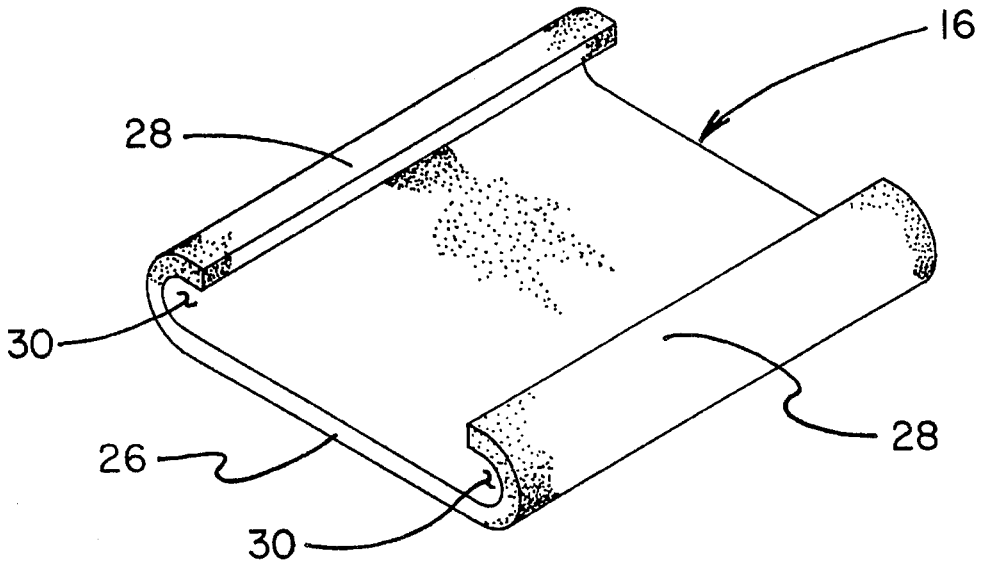
FIG. 7 is an isometric illustration of a cleaning pad comprising a further portion of the present invention.
Figure 9:
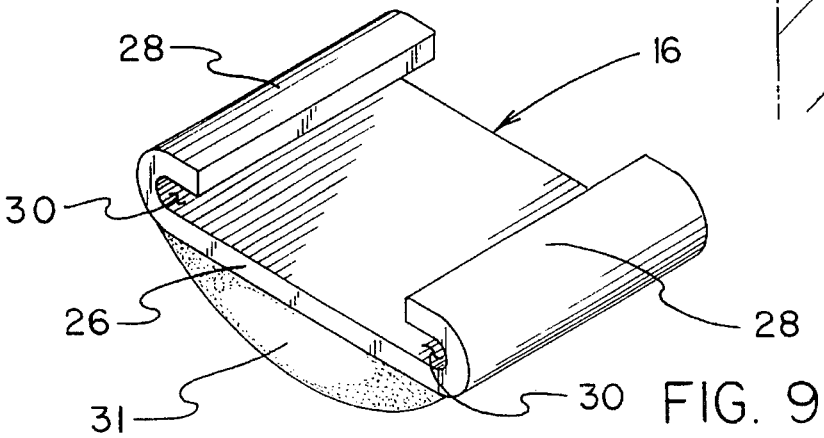
FIG. 9 is an isometric illustration of a cleaning pad including an arcuate sponge coupled to a lower surface thereof.

As best illustrated in FIGS. 2–5, the handle 12 is provided with a mounting base 18 at the lower distal end thereof which can be selectively engaged to the dispensing means 14 both to support the handle 12 in the vertical orientation illustrated in FIGS. 1 and 2, and to effect removal of a used cleaning pad and installation of a new cleaning pad 16 thereto. As shown in FIG. 6, the mounting base 18 includes a supporting flange 22 which projects laterally on opposed sides of the handle 12. The mounting base 18 further includes a pair of laterally opposed longitudinal projections 24 which extend along a longitudinal length of the mounting base 18. By this structure, a cleaning pad 16, such as is illustrated in FIGS. 7 and 9, can be removably coupled to the mounting base 18.

To provide for a removable coupling of the cleaning pads 16 to the mounting base 18, each of the cleaning pads comprises a substantially planar base pad 26 having arcuate lateral pads 28 extending from respectively opposed sides of the planar base pad. The arcuate lateral pads 28 can be integrally formed with the planar base pad 26 and are shaped so as to curve upwardly and inwardly to define a pair of opposed elongated channels 30 within which the longitudinal projections 24 of the mounting base 18 can be slidably positioned. The cleaning pads 16 are comprised of a material which may be utilized to scrub a toilet bowl or other bathroom surfaces and may include unillustrated wire members extending therethrough operable to retain the cleaning pads in the shape illustrated in FIG. 7. Further, it is desirable for the cleaning pads 16 to each be impregnated with a water soluble cleaning material which is released upon contact of the cleaning pad with a fluid, such as the water present within an unillustrated toilet bowl to be cleaned. As shown in FIG. 9, the cleaning pads may each additionally comprise an arcuate sponge 31 coupled to a lower surface of the planar base pad 26 so as to facilitate cleaning of arcuate or curved structures. Because of the arcuate shape of the arcuate sponge 31, the sponge will fit between the arcuate lateral pads 28 of adjacent cleaning pads 16 when positioned in the stacked configuration illustrated in FIG. 6.

Figure 8:
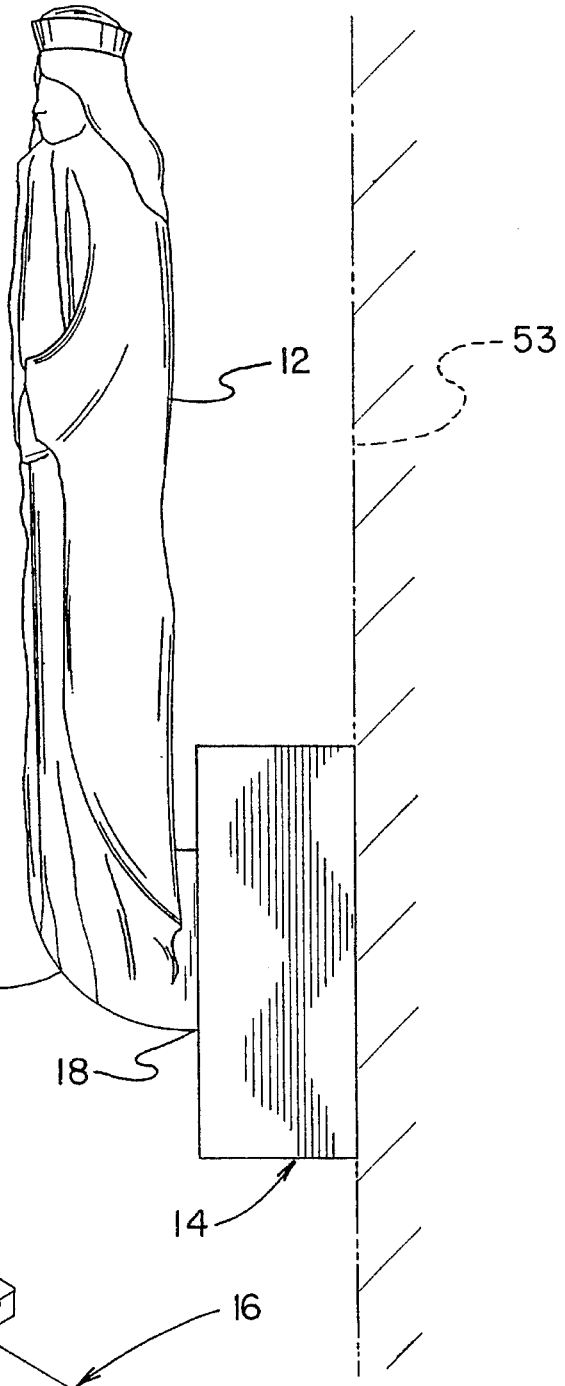
FIG. 8 is a side elevation view of an alternative form of the invention.

Referring back now to FIGS. 4 and 5, with concurrent reference to FIG. 6, it can be shown that the dispensing means 14 comprises a substantially rectangular enclosure 32 including a top wall 34 having a first rectangular aperture 36 extending therethrough and a second rectangular aperture 38 similarly directed therethrough, with the second rectangular aperture being positioned in contiguous communication with the first rectangular aperture 36. The first rectangular aperture 36 is characterized as having a transverse width substantially larger than a transverse width of the second rectangular aperture 38 substantially as shown in FIG. 4. A divider wall 40 extends transversely across an interior of the rectangular enclosure 32 to divide the interior of the enclosure into a waste container 42 and a supply container 44. The waste container 42 is positioned beneath the first rectangular aperture 36 and a portion of the second rectangular aperture 38, with the supply container 44 being positioned exclusively beneath the second rectangular aperture. The supply container 44 is operable to retain a plurality of the cleaning pads 16 in a stacked configuration, as illustrated in FIG. 6. The stacked pads 6 are biased against an interior surface of the top wall 34 by a spring 46 which engages a support plate 48 positioned beneath the stack of cleaning pads 16. By this structure, and as illustrated in FIG. 5, the mounting base 18 of the handle 12 can be positioned into engagement with the dispensing means 14 through a projection of the mounting base through the first rectangular aperture 36. The handle 12, and the associated mounting base 18, can then be slid into the second rectangular aperture 38 to removably couple the handle 12 to the dispensing means 14 for storage, as shown in FIG. 1. Should an individual desire to install a new cleaning pad 16 onto the mounting base 18, the same can be biased past the divider wall 40 and into the supply container 44, whereby the used cleaning pad 50 mounted thereon will engage one of the new cleaning pads 16 to be slidable disengaged from the mounting base. The used cleaning pad 50, after complete disengagement from the mounting base 18 will simply fall into a bottom of the waste container 42. The mounting base 18 will then be subsequently engaged to the uppermost new cleaning pad 16, whereby the handle 12 can be separated from the dispensing means 14 through a reverse sliding engagement of the mounting base 18 and subsequent removal of the mounting base through the first rectangular aperture 36. By this structure, the dispensing means 14 not only supports the handle 12 in a substantially vertical orientation for storage, but also permits a user to interchange the cleaning pads 16, 50 without direct contact therewith. As shown in FIG. 8, the handle 12 may additionally be provided with an integral orthogonal bend 51 which permits mounting of the dispensing means 14 to a vertical wall surface 53 while still retaining the handle in a substantially vertical orientation. The integral bend 51 further permits ease of manipulation of the handle 12 and associated cleaning pad 16 under objects, such as the rim of a toilet bowl for example.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by LETTERS PATENT of the United States is as follows:

1. A toilet bowl cleaning implement comprising:.

a handle of substantially elongated configuration;

a plurality of cleaning pads;

a dispensing means for supporting said handle in a substantially vertical orientation and further for supplying said cleaning pads, arranged for removable coupling with a lower distal end of said handle;

wherein said handle includes a mounting base at said lower distal end thereof which can be selectively engaged to said dispensing means to support said handle in said substantially vertical orientation, said dispensing means being adapted to dispense a selected one of the cleaning pads for coupling with the lower distal end of the handle;

wherein said mounting base includes a supporting flange projecting laterally on opposed sides of said handle; a pair of laterally opposed longitudinal projections extending along a longitudinal length of said mounting base;

wherein said cleaning pads each comprise a substantially planar base pad having arcuate lateral pads extending from respectively opposed sides of said planar base pad, said arcuate lateral pads being integrally formed with said planar base pad and shaped so as to curve upwardly and inwardly to define a pair of opposed elongated channels within which said longitudinal projections of said mounting base can be slidably positioned.

2. The toilet bowl cleaning implement of claim 1, wherein said dispensing means comprises a substantially rectangular enclosure including a top wall having a first rectangular aperture extending therethrough and a second rectangular aperture directed therethrough, with said second rectangular aperture being positioned in contiguous communication with said first rectangular aperture, said first rectangular aperture having a transverse width substantially larger than a transverse width of said second rectangular aperture; a divider wall extending transversely across an interior of said rectangular enclosure to divide an interior of said enclosure into a waste container and a supply container, wherein said waste container is positioned beneath said first rectangular aperture and a portion of said second rectangular aperture, with said supply container being positioned exclusively beneath said second rectangular aperture, said supply container being operable to retain a plurality of new cleaning pads in a stacked configuration; a support plate positioned beneath said plurality of new cleaning pads; and a spring engaged to said support plate, whereby said mounting base of said handle is positionable into engagement with said dispensing means through a projection of said mounting base through said first rectangular aperture, said mounting base of said handle being slidable into said second rectangular aperture to removably couple said handle to said dispensing means for storage, said mounting base of said handle being further slidable past said divider wall and into said supply container, whereby a used cleaning pad mounted thereon will engage one of said new cleaning pads to be slidably disengaged from said mounting base, with said mounting base subsequently slidably engaging an uppermost one of said new cleaning pads, whereby said handle is slidably separable from said dispensing means through a reverse sliding movement of said mounting base and subsequent removal of said mounting base through said first rectangular aperture.

3. The toilet bowl cleaning implement of claim 2, wherein said cleaning pads are comprised of a scrubbing material and are impregnated with a water soluble cleaning material which is released upon contact of said cleaning pads with a fluid.

4. The toilet bowl cleaning implement of claim 3, wherein each of said cleaning pads further comprises an arcuate sponge secured to a lower surface of said planar base pad.

5. The toilet bowl cleaning implement of claim 4, wherein said handle is shaped so as to define an intergral orthogonal bend.

6. The toilet bowl cleaning implement of claim 5, wherein said handle is shaped so as to resemble the form of a goddess.

7. A toilet bowl cleaning implement comprising:

a handle of substantially elongated configuration, the handle having a lower distal end;

a cleaning pad;

wherein said handle includes a mounting base at said lower distal end thereof, said mounting base including a supporting flange projecting laterally on opposed sides of said handle; and a pair of laterally opposed longitudinal projections extending along a longitudinal length of said mounting base;

wherein said cleaning pad comprises a substantially planar base pad having arcuate lateral pads extending from respectively opposed sides of said planar base pad, said arcuate lateral pads being integrally formed with said planar base pad and shaped so as to curve upwardly and inwardly to define a pair of opposed elongated channels within which said longitudinal projections of said mounting base can be slidably positioned.

8. The toilet bowl cleaning implement of claim 7, wherein said cleaning pad is comprised of a scrubbing material and is impregnated with a water soluble cleaning material which is released upon contact of said cleaning pad with a fluid.

9. The toilet bowl cleaning implement of claim 8, wherein said cleaning pad further comprises an arcuate sponge secured to a lower surface of said planar base pad.

* * * * *